United States Patent [19]

Suzuki et al.

[11] Patent Number: 4,757,177

[45] Date of Patent: Jul. 12, 1988

[54] HIGH-FREQUENCY INDUCTION HEATING SYSTEM WITH CIRCUIT PROTECTIVE FEATURE

[75] Inventors: Toshio Suzuki; Nobuo Kobayashi, both of Kanagawa, Japan

[73] Assignee: Sony Corporation, Tokyo, Japan

[21] Appl. No.: 904,469

[22] Filed: Sep. 8, 1986

[30] Foreign Application Priority Data

Sep. 20, 1985 [JP] Japan ..... 60-208440

[51] Int. Cl.[4] ..... H05B 6/12

[52] U.S. Cl. ..... 219/10.77; 219/10.75; 219/10.493; 361/89; 361/90; 361/93; 361/111

[58] Field of Search ..... 219/10.75, 10.77; 361/86, 89, 90, 111, 93; 363/82, 81, 89, 90, 37; 323/299; 340/662, 663

[56] References Cited

U.S. PATENT DOCUMENTS 4,016,390 4/1977 Amagami ..... 219/10.77
4,161,022 7/1979 Kanazawa et al. ..... 363/88
4,599,504 7/1986 Ito ..... 219/10.77

FOREIGN PATENT DOCUMENTS 54-31646 3/1979 Japan .

*Primary Examiner*—A. D. Pellinen
*Assistant Examiner*—Leon K. Fuller
*Attorney, Agent, or Firm*—Ronald P. Kananen

[57] ABSTRACT

A high-frequency induction system can generally be achieved by detecting noise superimposed on AC power supply which might induce voltages exceeding the given break-down voltage of a switching device and in such cases by temporarily shutting off the power supply to the induction heating system. To implement this, a high-frequency induction heating system, according to the invention, is provided with a noise detector circuit connected to the output terminal of a rectifying circuit rectifying said input AC voltage. The noise detector is designed to detect noise pulses superimposed on an input AC voltage. The induction heating system of the present invention also includes means for disabling a switching device. The disabling means responds to detection of a noise pulse by the noise detector by disabling the switching device and whereby protects the circuit of the induction heating system.

31 Claims, 1 Drawing Sheet

HIGH-FREQUENCY INDUCTION HEATING SYSTEM WITH CIRCUIT PROTECTIVE FEATURE

BACKGROUND OF THE INVENTION

1. Field of the Invention

The present invention relates generally to a high-frequency induction heating system which is applicable to electromagnetic cooking heaters, for example. More specifically, the invention relates to circuit protection for a high-frequency induction heating system which protects the circuitry of the induction heating system from high-voltage noise which may be superimposed on the power supply voltage.

2. Description of the Prior Art

As is well known, a high-frequency induction heating system, such as that utilized in electromagnetic cooking heaters, comprises an induction element. The induction element typically comprises an induction coil supplied with a relatively high-frequency AC signal in order to generate an alternating magnetic flux. A conducting material, such as an iron pan or the like, is placed within the flux, whereby eddy currents are induced in the material, and the induced eddy currents produce heat. The amount of heat induced is a function of the frequency of the flux as well as its intensity. The intensity of the flux is a function of the power supplied to the induction element, while the frequency at which the flux changes is determined by opening and closing a switching device which is connected in series with the element. Thus, the amount of heating which is produced by the induction heating system is controlled by controlling the frequency at which the switching device operates and by controlling the amount of power which is supplied to the heating device.

Such high-frequency induction systems have been disclosed in the U.S. Pat. No. 4,161,022, issued to Kanazawa et al, on July 10, 1979, and in the Japanese Patent First Publication (Tokkai) Showa No. 54-31646, published on Mar. 8, 1979, both of which have been assigned to the owner of the present invention.

In such high-frequency induction heating systems, power is supplied by a commercial AC power source. Noise is commonly superimposed on the power supply from the power source. Noise spikes, however, apply significant loads on the switching devices used in the induction heating system. In particular, in areas where the commercial AC power is at a relatively high voltage, e.g. 220 V, the load exerted on the switching device by noise may be heavy enough to damage it.

In practice, AC voltage from a commercial AC power source is supplied to a rectifying circuit via a power switch for rectification. The rectified output of the rectifying circuit is supplied to a smoothing circuit for conversion to DC. An induction coil and the switching device which may comprise a switching transistor are connected in series across the output terminals of the smoothing circuit. A capacitor for resonance is connected to one output terminal of the smoothing circuit in parallel with the induction coil. A damper diode is connected in parallel across the collector and emitter of the switching transistor.

When a switching pulse is applied to the switching transistor, a saw-tooth waveform current passes through the collector electrode of the switching transistor, and also a half-wave rectified voltage appears at the the collector electrode of the switching transistor due to the resonance of the induction coil and the capacitor.

Therefore, if a cooking pan were placed near the induction coil at this time, the pan would be heated by eddy-current losses in the magnetic flux generated by the induction coil, so that cooking could be carried out.

When a noise spike is superimposed on the AC power supply, such as is commonly generated when another relatively heavy load, such as a refrigerator, is switched on, the collector voltage can exceed the collector break-down voltage (generally about 1000 V) of the switching transistor. In such a case, the switching transistor can easily be destroyed.

Break-down of the switching transistor can be prevented by using a transistor with a sufficiently large break-down voltage. However, the switching properties of a switching transistor are generally inversely related to the break-down voltage of its collector, so that a switching transistor with a collector having a high break-down voltage will have disadvantageous switching properties and will not be suitable for high-frequency induction heating.

Furthermore, although switching transistors with both superior switching characteristics and a high collector break-down voltage are available on the market, such transistors are bulky and expensive. Therefore, from the point of view space and cost, transistors with superior switching characteristics and collector break-down voltage cannot be used.

SUMMARY OF THE INVENTION

It is a general object of the present invention to provide a high-frequency induction heating system which is free from the above problems.

Another object of the invention is to provide a high-frequency induction heating system with a circuit protecting feature, which successfully protects the circuit of the induction heating system, especially the switching device thereof.

A further object of the invention is to provide a protection circuit for high-frequency induction heating systems, which is easily applicable to conventional induction heating circuitry.

According to the present invention, the aforementioned objects can generally be achieved by detecting noise superimposed on an AC power supply which might induce voltages exceeding the given break-down voltage of a switching device and in such cases by temporarily shutting off the power supply to the induction heating system.

To implement this solution, a high-frequency induction heating system, according to the invention, is provided with a noise detector circuit connected to the output terminal of a rectifying circuit for rectifying the input AC voltage. The noise detector is designed to detect noise pulses superimposed on an input AC voltage. The induction heating system of the present invention also includes means for disabling a switching device. The disabling means responds to detection of a noise pulse by the noise detector by disabling the switching device.

In accordance with one aspect of the invention, a high-frequency induction heating system comprises a power source means for supplying electrical power, an induction means for generating a magnetic flux therearound, a switching means, associated with the induction means, for periodically interrupting the power supply to the induction means at a high frequency so that the magnetic flux oscillates, and means for monitoring the power supply and detecting when the power supply conditions fall outside of predetermined acceptable conditions and in such cases generating a disabling signal to disable the switching means.

The power source means may include a first power source for supplying power to the induction means and a second power source for supplying power to the switching means.

The power supply monitoring means is preferably responsive to power supply conditions returning to within the predetermined conditions after being outside of the predetermined conditions to produce an enabling signal allowing the switching means to operate. The power supply monitoring means monitors power supply voltage and is responsive to the power supply voltage exceeding a given voltage to produce the disabling signal. Preferably, the power source means includes an AC power source and an AC-to-DC converting means for supplying DC power to the induction means, and the power supply monitoring means monitors the AC power supply in order to detect when the power supply voltage exceeds a given voltage. In the preferred circuit construction, the power supply monitoring means includes a differentiating circuit for differentiating AC power supplied thereto, and detector means for detecting when an output of the differentiating circuit exceeds a given value representative of the given voltage of the AC power supply, and in such cases producing a HIGH-level signal which serves as the disabling signal. The detector means is responsive to the differentiating circuit output falling below the given value to output a LOW-level signal which serves as the enabling signal.

In the alternative, the power supply monitoring means monitors power supply voltage and is responsive to the power supply voltage falling below a given voltage to produce the disabling signal.

In another alternative embodiment, the high-frequency induction heating system further comprises a power switch which can be manually closed to establish a power supply circuit. The power supply monitoring means is responsive to closure of the power switch to produce the disabling signal for disabling the switching means for a given period of time.

The power supply monitoring means may also include a first detector for detecting when the power supply voltage exceeds a given voltage and in such cases producing a first detector signal, a second detector monitoring the power supply and responsive to unstable power supply conditions to produce a second detector signal, and a disabling/enabling signal generator responsive to one of the first and second detector signals to produce the disabling signal for disabling the switching means. Alternatively, the power supply monitoring means may include a first detector for detecting when the power supply voltage exceeds a given voltage and in such cases producing a first detector signal, a second detector responsive to closure of the power switch to produce a second detector signal for a given period of time, and a disabling/enabling signal generator responsive to one of the first and second detector signals to produce the disabling signal for disabling the switching means. In a further alternative embodiment, the power supply monitoring circuit may include a first detector for detecting when the power supply voltage exceeds a given voltage to produce a first detector signal, a second detector monitoring the power supply and responsive to unstable power supply conditions to produce a second detector signal, a third detector responsive to closure of the power switch to produce a third detector signal for a given period of time, and a disabling/enabling signal generator responsive to any of the first, second and third detector signals to produce the disabling signal for disabling the switching means.

According to another aspect of the invention, a high-frequency induction heating system comprises an AC power source means for supplying AC power, a first DC power source for converting AC power from the AC power source into a first DC power, a second DC power source for converting AC power from the AC power source into a second DC power, an induction means, receiving the first DC power supply, for generating a magnetic flux therearound, a switching means, associated with the induction means, for periodically transmitting and interrupting the first DC power to the induction means at a high frequency so that the magnetic flux oscillates, a drive means, associated with the switching means and receiving the second DC power from the second DC power source, for supplying a driving signal to the switching circuit by which the latter is ordered to periodically transmit and interrupt the first DC power, and means for detecting preselected disabling conditions in the AC power supply and in such cases generating a disabling signal to disable the switching means.

In the preferred embodiment, the AC power supply monitoring means comprises at least one of a first detector for detecting when noise with an excessively high voltage is superimposed on the AC power and in such cases producing a first detector signal, a second detector for detecting temporary drops in supply voltage and in such cases producing a second detector signal, and a third detector for detecting the onset of AC power supply and in such cases producing a third detector signal, and a disabling signal generator for producing the disabling signal in response to one of or any of the first, second and third detector signals.

According to a further aspect of the invention, a method for protecting a circuit in a high-frequency induction heating system comprising a power source means for supplying electrical power, an induction means for generating a magnetic flux therearound, and a switching means, associated with said induction means, for periodically interrupting power supply to said induction means at a high frequency so that said magnetic flux oscillates, comprises the steps of:

monitoring a power supply and detecting when power supply conditions fall outside of predetermined acceptable conditions; and generating a disabling signal to disable said switching means in resonse to the detecting step.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment illustrated but are for explanation and understanding only.

In the drawings.

DESCRIPTION OF THE PREFERRED EMBODIMENT

Figure 1:
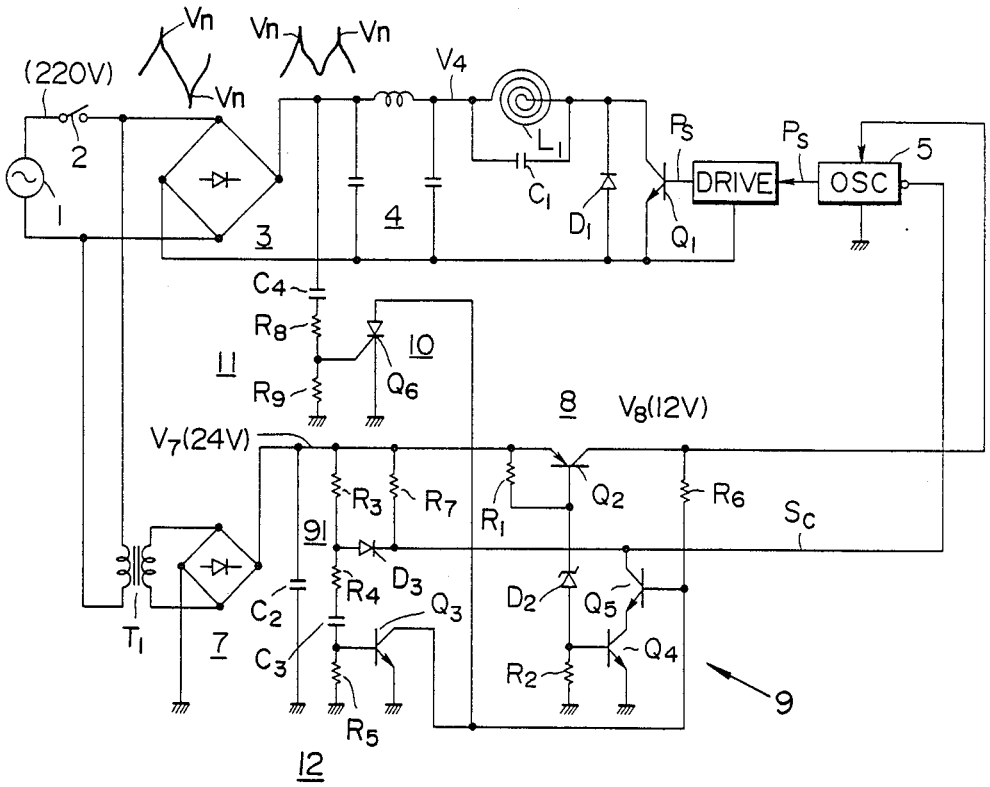
FIG. 1 is a circuit diagram of the preferred embodiment of a high-frequency induction heating system according to the present invention.

Referring now to the drawings, the preferred embodiment of a high-frequency induction heating system, according to the present invention, is connected to an AC power source 1. The AC power source 1 employed may be a commercial AC power source. The AC power from the power source 1 is supplied to a rectifying circuit 3, such as a bridge rectifier circuit, through a power switch 2. The rectifying circuit 3 rectifies the AC power from the power source 1, and the rectified output is supplied to a smoothing circuit 4. The smoothing circuit 4 converts the rectified AC power to a DC voltage $V_4$. An induction coil $L_1$ and the collector and emitter electrodes of a switching transistor $Q_1$ are connected in series across the output terminals of the smoothing circuit 4. The switching transistor $Q_1$ serves as a gate-controlled switching device. A capacitor $C_1$ for resonance is connected to one output terminal of the smoothing circuit 4 in parallel with the induction coil $L_1$. A damper diode $D_1$ is connected in parallel across the collector and emitter electrodes of the switching transistor $Q_1$.

Figure 2:
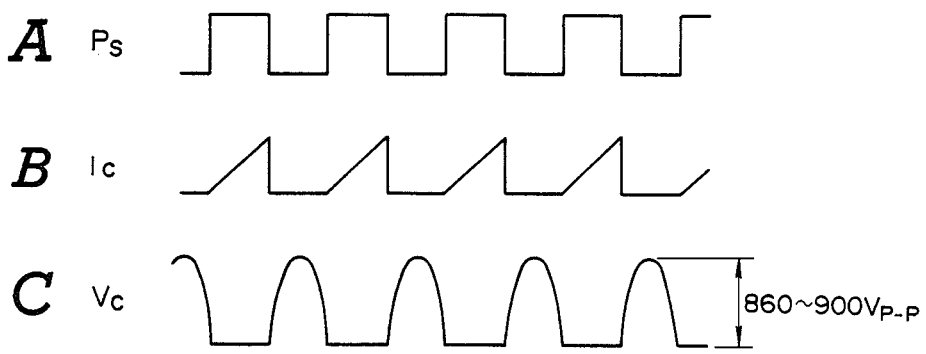
FIGS. 2(A) to 2(C) show waveforms generated by the circuit of FIG. 1.

A voltage-controlled oscillator circuit 5 and a driver circuit 6 are connected to the base electrode of the switching transistor $Q_1$. The voltage-controlled oscillator circuit 5 is connected to an operation control signal generator circuit 9 to receive therefrom an operation control signal $S_c$, which control circuit 9 will be described later. The control signal $S_c$ switches between LOW and HIGH signal levels. When the level of the control signal $S_c$ is LOW, the voltage-controlled oscillator 5 is enabled to generate a drive pulse $P_s$ as shown in FIG. 2(A). On the other hand, the voltage-controlled oscillator circuit 5 is disabled in response to the HIGH-level operation control signal $S_c$. Therefore, as long as the operation control signal $S_c$ remains HIGH, the voltage-controlled oscillator circuit 5 remains inoperative.

The voltage-controlled oscillator circuit 5 is also connected to a oscillation drive power generator circuit 8 to receive a drive voltage. The voltage-controlled oscillator circuit 5, when enabled by the LOW level operation control signal $S_c$, generates a pulse train having a relatively high frequency. The pulse train from the voltage-controlled oscillator circuit 5 is applied to the driver circuit 6. The driver circuit 6 generates a high-frequency drive signal $P_s$ for driving the switching transistor $Q_1$. The drive signal $P_s$ is applied to the base electrode of the transistor $Q_1$. The drive signal $P_s$ is in the form of rectangular pulses of high frequency, as shown in FIG. 2(A).

When the drive signal $P_s$ applied to the base of the transistor $Q_1$ is HIGH, the switching transistor $Q_1$ becomes conductive. While the switching transistor $Q_1$ remains conductive, a collector current $I_c$ flows through the collector electrode of the transistor $Q_1$ as shown in FIG. 2(B). On the other hand, in response to the LOW-level drive signal $P_s$, the collector voltage $V_c$ shown in FIG. 2(C) appears at the collector electrode of the switching transistor $Q_1$ due to the resonance of the coil $L_1$ and the capacitor $C_1$. Therefore, the induction coil $L_1$ acting as an induction element is subjected to a high-frequency input which elicits an alternating magnetic flux. When conductive material, such as an iron pan or the like, is placed in the path of the flux, eddy currents are induced therein, and these induced eddy currents produce heat. Therefore, when such an induction heating system is used as an electromagnetic cooking heater, a cooking pan made of a conductive material is placed near the heating coil $L_1$ within the flux. The pan is thereby heated by eddy-currents, so that cooking can be carried out.

The AC power source 1 is also connected to a rectifier circuit 7, such as a bridge rectifier, via a transformer $T_1$. The AC power from the AC power source is stepped down by a transformer $T_1$ and then is applied to the rectifier circuit 7. A capacitor $C_2$ for smoothing is supplied with the rectified output and produces, for example, a 24 V DC voltage $V_7$. The collector and emitter electrodes of a transistor $Q_2$ are connected between the output terminal for the voltage $V_7$ and a power line on the hot-end side of the voltage-controlled oscillator circuit 5. This transistor $Q_2$ constitutes a voltage regulator of the oscillation drive signal generator circuit 8. A resistor $R_1$ is connected between the collector and base electrodes of the transistor $Q_2$. A voltage regulation diode $D_2$ (with a Zener voltage of 12 V, for example) and a resistor $R_2$ are connected in series between the base electrode of the transistor $Q_2$ and ground. A constant voltage $V_8$ of, for example, 12 V is produced by the transistor $Q_2$ and the oscillating circuit 5 is supplied with the voltage $V_8$ serving as the drive voltage. Although not illustrated, the driver circuit 6 is also connected to the AC power source 1 through an appropriate power regulator circuit to receive a drive voltage.

The preferred embodiment of the induction heating system according to the invention further comprises a power detector circuit 12. The power detector circuit 12 comprises transistors $Q_3$ to $Q_5$ and other elements. This power detector circuit 12 is designed to protect the circuitry of the induction heating system, especially the switching transistor $Q_1$, even if the output voltage $V_4$ of the smoothing circuit 4 and the rectifier output voltage $V_7$ become unstable and so rise abruptly while the system is in use. In addition, a time-constant circuit 91 which is predominantly a series circuit including resistors $R_3$, $R_4$, capacitor $C_3$ and resistor $R_5$ is connected between the hot-end side of the capacitor $C_2$ and ground. In addition, the junction between the capacitor $C_3$ and the resistor $R_5$ is connected to the base electrode of the transistor $Q_3$, the emitter electrode of which is connected to ground, and the emittor electrode of which is connected to the collector electrode of the transistor $Q_2$ via a resistor $R_6$. Furthermore, the collector electrode of the transistor $Q_3$ is connected to the base electrode of the transistor $Q_5$. The collector electrode of the transistor $Q_5$ is connected to the hot-end side of the capacitor $C_2$ via a resistor $R_7$. The collector-emitter path of the transistor $Q_4$ is connected between the emitter electrode of the transistor $Q_5$ and ground. The base electrode of the transistor $Q_4$ is connected to the junction between the diode $D_2$ and the resistor $R_2$. A diode $D_3$ is connected to the junction between the resistors $R_3$ and $R_4$ and the collector electrode of the transistor $Q_5$. The voltage obtained at the collector electrode of the transistor $Q_5$ serves as the operation control signal $S_c$ for the voltage-controlled oscillator 5.

Furthermore, a detecting circuit 10 for detecting noise pulses $V_n$ comprises a unilateral three-terminal thyristor (SCR) $Q_6$ or the like. A differentiating circuit 11, which is a series circuit including a capacitor $C_4$ and resistors $R_8$ and $R_9$, is connected between the output terminal on the hot-end side of the rectifying circuit 3 and ground. Furthermore, the junction between the resistors $R_8$ and $R_9$ is connected to the gate of the thyristor $Q_6$, the anode electrode of which is connected to the collector electrode of the transistor $Q_3$ and the cathode electrode of which is connected to ground. When the output of the differentiating circuit 11 exceeds a given set value which represents the maximum allowable rectifier circuit output voltage, the thyristor $Q_6$ is turned ON. The thyristor then becomes conductive whereby the potential at the base electrode of the transistor $Q_5$ drops so as to turn the latter OFF.

It should be noted that, in this specific embodiment, the capacity of the capacitor $C_4$ is set to 470 pF. Also, the resistance of the resistors $R_8$ and $R_9$ are respectively set at 15 kΩ and 7.5 kΩ.

When the switch 2 is closed, a DC voltage $V_4$ is produced by the smoothing circuit 4 with the aid of the rectifying circuit 3, so that the series circuit comprising the coil $L_1$ and transistor $Q_1$ is supplied with the voltage $V_4$.

At the same time, a DC voltage $V_7$ produced by the rectifying circuit 7 with the aid of the capacitor $C_2$ is stabilized to a voltage $V_8$ by means of the voltage regulating operation of the circuit 8. Therefore, the oscillator circuit 5 is supplied with the stabilized voltage $V_8$ serving as the drive voltage.

The voltage $V_7$ also appears on the line connecting the resistor $R_3$ to the base electrodes of the transistor $Q_3$ via the resistor $R_4$ and the capacitor $C_3$ and current flows therethrough. In response to this signal, the transistor $Q_3$ goes ON and the transistor $Q_5$ goes OFF. This causes an increase in the voltage at the collector electrode of the transistor $Q_5$. As a result, the operation control signal $S_c$ goes HIGH. Therefore, when the voltage $V_7$ is first produced, the oscillator circuit 5 is supplied with part of the voltage $V_7$ serving as a HIGH-level operation control signal $S_c$ via the resistor $R_7$. This HIGH-level operation control signal $S_c$ disables the oscillator circuit 5. In the absence of the pulse train from the oscillator circuit 5, the driver circuit 6 remains inoperative and so does not apply the drive signal $P_s$ to the base electrode of the transistor $Q_1$. Therefore, the transistor $Q_1$ remains OFF. In other words, even after the switch 2 is closed, the transistor $Q_1$ remains off as long as the power supply is in a transient state.

However, the capacitor $C_3$ is gradually charged by the voltage $V_7$ on the line connecting the resistor $R_3$ to the resistor $R_5$ and the base electrode of the transistor $Q_3$ via the resistor $R_4$ and the capacitor $C_3$. After expiration of a period of time determined by the time-constant of the time-constant circuit 91 including the resistors $R_3$ and $R_4$ and the capacitor $C_3$, the power supply is initiated. In response to this, the transistor $Q_3$ goes OFF and the base voltage of the transistor $Q_5$ goes HIGH. In this case, since the voltage $V_7$ is divided by the resistor $R_1$, the diode $D_2$ and the resistor $R_2$, the transistor $Q_4$ receives the divided voltage. This divided voltage turns the transistor $Q_4$ ON. At this time, since the transistor $Q_5$ becomes conductive, the operation control signal $S_c$ applied to the oscillator circuit 5 is grounded through the transistors $Q_5$ and $Q_4$. Therefore, the operation control signal $S_c$ goes LOW and so enables the oscillator circuit 5. The oscillator circuit 5 is thus activated to output the pulse train to the driver circuit 6. The driver circuit 6 is responsive to the pulse train from the oscillator circuit 5 to output the drive signal $P_s$ to the switching transistor $Q_1$.

During normal operation of the power supply, when no significant noise spikes $V_n$ are superimposed on the power supply, the DC power is supplied to the induction coil $L_1$ through the smoothing circuit 4. At the same time, the stepped-down voltage $V_7$ derived by the transformer $T_1$ and rectified by the rectifying circuit is supplied to the operation control signal generator 9 and the oscillation drive power generator 8. Since the voltage $V_7$ remains at its normal level, the voltage $V_8$ remains at its normal level. Therefore, the transistor $Q_4$ and $Q_5$ are held ON to hold the operation control signal $S_c$ level LOW and thus enable the oscillator circuit 5. On the other hand, the oscillation drive signal generator 8 generates the normal level of the drive voltage to drive the oscillator circuit 5 to output a pulse train of a predetermined frequency. The pulse train from the oscillator circuit 5 activates the driver circuit 6 to send the high-frequency drive signal to the switching transistor $Q_1$. The switching transistor $Q_1$ is thus switched ON and OFF alternatingly by the drive signal $P_s$ from the driver circuit 6. Switching the transistor $Q_1$ ON and OFF periodically interrupts the DC power supply to the induction coil $L_1$. Thus, the induction coil $L_1$ and the capacitor $C_1$ resonate to generate a magnetic flux therearound which heats conductive material within the flux due to eddy current losses.

At this time, since the voltage of the output of the rectifier circuit 3 remains within the normal range, the gate input of the thyristor $Q_6$ of the noise detecting circuit 10 from the differentiating circuit 11 remains below the set value. Therefore, the thyristor $Q_6$ remains OFF and so no current flows therethrough.

In cases where the AC power supply voltage drops due to temporary or momentary service interruption while the induction system is in operation, the voltage $V_7$ decreases. In response to the drop in the voltage $V_7$, the voltage $V_8$ decreases. This drop in the voltage $V_8$ lowers the drive voltage for the oscillator circuit 5. Therefore, the oscillating circuit 5 becomes unable to output a pulse train at the normal frequency.

The drop in the voltage $V_7$ also lowers the input voltage at the base electrode of the transistor $Q_4$, which input voltage is the voltage $V_7$ divided by the resistor $R_1$, the diode $D_2$ and the resistor $R_2$. In response to the drop in the input voltage, the transistor $Q_4$ goes OFF. Similarly, as the transistor $Q_4$ goes OFF, the transistor $Q_5$ also goes OFF. The voltage at the collector electrode of the transistor $Q_5$ thus rises and turns the operation control signal $S_c$ level HIGH. As stated previously, the oscillator circuit 5 is disabled by the HIGH-level operation control signal $S_c$. This deactivates the switching transistor $Q_1$. Therefore, if the operation should become unstable due to a decrease in the input AC voltage during operation, the switching transistor $Q_1$ will go OFF and the transistor and the entire system will be protected.

On the other hand, when noise spikes $V_n$ are superimposed on the input AC power supply during heating, an abnormally high voltage will appear at the output side of the rectifier circuit 3. In this case, the DC power is supplied to the induction coil $L_1$ through the smoothing circuit 4. Also the voltages $V_7$ and $V_8$ are applied to the operation control signal generator circuit 9 and the oscillation drive power generator circuit 8. At the same time, the output of the rectifier circuit 3, which will include the noise spikes $V_n$, is sent to the differentiating circuit 11. The differentiating circuit differentiates the input from the rectifier circuit 3. The differentiated output of the differentiating circuit 11 is then applied to the gate of the thyristor $Q_6$ as the gate input. Since the noise spikes $V_n$ are superimposed on the power supply, the gate input of the thyristor $Q_6$ will at least briefly become higher than the set value. Therefore, the thyristor $Q_6$ turns ON. When turned on, the thyristor $Q_6$ establishes a shorting circuit connecting the collector electrode of the transistor $Q_3$ to ground. As a result, the potential at the base electrode of the transistor $Q_5$ drops, and turns it OFF. Therefore, the collector voltage of the transistor $Q_5$ rises, whereby a HIGH-level operation control signal $S_c$ is sent to the oscillator circuit 5. Thus, the oscillating circuit 5 is disabled. Therefore, the switching transistor $Q_1$ remains inoperative. In summary, the switching transistor $Q_1$ is protected from noise pulses $V_n$.

While the transistors $Q_4$ and $Q_5$ are both ON, the charge on the capacitor $C_3$ is discharged though a discharge circuit established by the resistor $R_4$, the diode $D_3$ and the transistors $Q_4$ and $Q_5$. When the transistor $Q_5$ is turned off, the discharge circuit for the capacitor $C_3$ is broken. At this time, the voltage $V_7$ is still supplied to the capacitor $C_3$. Therefore, the capacitor $C_3$ charges up to its given capacity. As long as the the capacitor $C_3$ remains in a condition for charging, the input to the base electrode of the transistor $Q_3$ remains HIGH. Therefore, the transistor $Q_3$ remains ON and holds the current through the anode electrode of the thyristor $Q_6$ below the holding current of the thyristor. Therefore, the thyristor $Q_6$ is turned OFF.

Once the capacitor $C_3$ is fully charged, current flow through the capacitor $C_3$ is blocked. Therefore, the input at the base electrode of the transistor $Q_3$ goes LOW. Therefore, the transistor $Q_3$ goes OFF. The voltage at the collector electrode of the transistor $Q_3$ then rises and the input to the base electrode of the transistor $Q_5$ goes HIGH. The transistor $Q_4$ receives the voltage $V_7$ divided by the resistor $R_1$, the diode $D_2$ and the resistor $R_2$. This divided voltage also turns the transistor $Q_4$ ON. The transistor $Q_5$ is made conductive, thus grounding the input to the oscillator circuit 5, i.e. the operation control signal $S_c$, through the transistors $Q_5$ and $Q_4$. Therefore, the operation control signal $S_c$ goes LOW and enables the oscillator circuit 5. The oscillator circuit 5 is thus activated to output the pulse train to the driver circuit 6. The driver circuit 6 responds to the pulse train from the oscillator circuit 5 by outputting the drive signal $P_s$ to the switching transistor $Q_1$. Thus, the switching transistor $Q_1$ again switches ON and OFF to re-start the induction heating process.

As mentioned above, in accordance with the present invention, abrupt noise pulses $V_n$ superimposed on the input AC voltage are detected by the detecting circuit 10. Then, the transistor $Q_1$ goes OFF. Therefore, even during operation (heating) when a collector voltage $V_c$ of 860 to 900 $V_{p-p}$ is being applied to the switching transistor $Q_1$ as shown in FIG. 2(C), the transistor $Q_1$ will not be destroyed by the noise $V_n$.

Furthermore, since the transistor $Q_1$ need not have a special collector break-down voltage, the transistor need not be large, so that it is profitable from the point of view of space and design, and from the point of view of cost as well.

Furthermore, since an element designed for good switching properties can be used as the transistor $Q_1$, the capacity of the magnetic cooking appliance can be improved. Furthermore, since resistance to noise is improved, the reliability of the magnetic cooking appliance will be also improved.

Furthermore, since the noise pulse $V_n$ is detected in the output of the rectifying circuit 3, the response to detection will be fast and the transistor will be reliably protected. Furthermore, since the differentiating circuit 11 is supplied with the rectifying output of the rectifying circuit 3, only noise pulses $V_n$ will be detected and erroneous operation due to ripple components in the rectifying output is prevented.

While the present invention has been disclosed in terms of the preferred embodiment in order to facilitate a better understanding of the invention, it should be appreciated that the invention can be embodied in various ways without departing from the principle of the invention. Therefore, the invention should be understood to include all possible embodiments and modifications to the shown embodiments which can be embodied without departing from the principles of the invention set out in the appended claims.

What is claimed is:

1. A high-frequency induction heating system comprising:

a power source means for supplying electrical power;

an induction means for generating a magnetic flux therearound;

a switching means, associated with said induction means, for periodically interrupting the power supply to said induction means at a high frequency so that said magnetic flux oscillates; and means for monitoring the power supply and detecting when the power supply conditions fall outside of predetermined acceptable conditions and in such cases generating a disabling signal to disable said switching means, said monitoring means being responsive to noise of excessively high voltage superimposed on the supplied power for disabling said switching means for a predetermined period of time.

2. A high-frequency induction heating system as set forth in claim 1, wherein said power supply monitoring means is responsive to the power supply conditions returning to within said predetermined conditions after being outside of said predetermined conditions to produce an enabling signal causing said switching means to operate.

3. A high-frequency induction heating system as set forth in claim 1, wherein said power source means includes a first power source for supplying power to said induction means and a second power source for supplying monitored power to said switching means.

4. A high-frequency induction heating system as set forth in claim 2, wherein said power supply monitoring means monitors the power supply voltage and is responsive to the power supply voltage exceedng a given voltage to produce said disabling signal.

5. A high-frequency induction heating system as set forth in claim 4, wherein said power source means includes an AC power source and an AC-to-DC converting means for supplying DC power to said induction means, and said power supply monitoring means monitors the AC power supply in order to detect when the power supply voltage exceeds said given voltage.

6. A high-frequency induction heating system as set forth in claim 5, wherein said power supply monitoring means includes a differentiating circuit for differentiating rectified AC power supplied thereto, and detector means for detecting when an output of said differentiating circuit exceeds a given value representative of said given voltage of said AC power supply and in such cases producing a HIGH-level signal which serves as said disabling signal.

7. A high-frequency induction heating system as set forth in claim 6, wherein said detector means is responsive to said differentiating circuit output falling below said given value to output a LOW-level signal which serves as said enabling signal.

8. A high-frequency induction heating system as set forth in claim 1, wherein said power supply monitoring means monitors the power supply voltage and is responsive to the power supply voltage falling below a given voltage to produce said disabling signal.

9. A high-frequency induction heating system as set forth in claim 1, which further comprises a power switch which can be manually closed to establish a power supply circuit, and said power supply monitoring means is responsive to closure of said power switch to produce said disabling signal for disabling said switching means for a given period of time.

10. A high-frequency induction heating system as set forth in claim 1, wherein said power supply monitoring means includes a first detector for detecting when the power supply voltage exceeds a given voltage and in such cases producing a first detector signal, a second detector monitoring said power supply and responsive to unstable power supply conditions to produce a second detector signal, and a disabling/enabling signal generator responsive to one of said first and second detector signals to produce said disabling signal for disabling said switching means.

11. A high-frequency induction heating system as set forth in claim 1, which futher comprises a power switch which can be manually closed to establish a power supply circuit, and said power supply monitoring means includes a first detector for detecting when the power supply voltage exceeds a given voltage and in such cases producing a first detector signal, a second detector responsive to closure of said power switch to produce a second detector signal for a given period of time, and a disabling/enabling signal generator responsive to one of said first and second detector signals to produce said disabling signal for disabling said switching means.

12. A high-frequency induction heating system comprising:

a power source means for supplying electrical power;

a power switch which can be manually closed to establish a power supply circuit;

an induction means for generating a magnetic flux therearound;

a switching means, associated with said induction means, for periodically interrupting the power supply to said induction means at a high frequency so that said magnetic flux oscillates;

means for monitoring the power supply and detecting when the power supply conditions fall outside of predetermined acceptable conditions and in such cases generating a disabling signal to disable said switching means, said power supply monitoring means including a first detector for detecting when the power supply voltage exceeds a given voltage to produce a first detector signal, a second detector monitoring said power supply and responsive to unstable power supply conditions to produce a second detector signal, a third detector responsive to closure of said power switch to produce a third detector signal for a given period of time, and a disabling/enabling signal generator responsive to any of said first, second and third detector signals to produce said disabling signal for disabling said switching means.

13. A high-frequency induction heating system comprising:

an AC power source means for supplying AC power;

a first DC power source for converting AC power from said AC power source into first DC power;

a second DC power source for converting AC power from said AC power source into second DC power;

an induction means, receiving said first DC power supply, for generating a magnetic flux therearound;

a switching means, associated with said induction means, for periodically transmitting and interrupting said first DC power to said induction means at a high frequency so that said magnetic flux oscillates;

a drive means, associated with said switching means and receiving said second DC power from said second DC power source, for supplying a driving signal to said switching circuit by which the latter is ordered to periodically transmit and interrupt said first DC power; and means for detecting preselected disabling conditions in said AC power supply and in such cases generating a disabling signal to disable said switching means, said monitoring means detecting noise of excessively high voltage superimposed on the supplied AC power for disabling said switching means.

14. A high-frequency induction heating system as set forth in claim 13, wherein said AC power supply monitoring means detects when a supply voltage exceeds a given value and in such cases produces said disabling signal.

15. A high-frequency induction heating system comprising:

an AC power source means for supplying AC power;

a first DC power source for converting AC power from said AC power source into first DC power;

a second DC power source for converting AC power from said AC power source into second DC power;

an induction means, receiving said first DC power supply, for generating a magnetic flux therearound;

a switching means, associated with said induction means, for periodically transmitting and interrupting said first DC power to said induction means at a high frequency so that said magnetic flux oscillates;

a drive means, associated with said switching means and receiving said second DC power from said second DC power source, for supplying a driving signal to said switching circuit by which the latter is ordered to periodically transmit and interrupt said first DC power; and means for monitoring AC power supply of said second AC power source and detecting preselected disabling conditions in said AC power supply and in such cases generating a disabling signal to disable said switching means, said AC power supply monitoring means detecting when noise of excessively high voltage is superimposed on the AC power and in such cases produces said disabling signal.

16. A high-frequency induction heating system as set forth in claim 13, wherein said AC power supply monitoring means detects temporary drops in supply voltage and in such cases produces said disabling signal.

17. A high-frequency induction heating system as set forth in claim 13, wherein said AC power supply monitoring means detects the onset of AC power supply and in such cases produces said disabling signal for a given period of time.

18. A high-frequency induction heating system comprising:

an AC power source means for supplying AC power;

a first DC power source for converting AC power from said AC power source into first DC power;

a second DC power source for converting AC power from said AC power source into second DC power;

an induction means, receiving said first DC power supply, for generating a magnetic flux therearound;

a switching means, associated with said induction means, for periodically transmitting and interrupting said first DC power to said induction means at a high frequency so that said mangetic flux oscillates;

a drive means, associated with said switching means and receiving said second DC power from said second DC power source, for supplying a driving signal to said switching circuit by which the latter is ordered to periodically transmit and interrupt said first DC power; and means for monitoring AC power supplied from said second AC power source and detecting preselected disabling conditions in said AC power supply and in such cases generating a disabling signal to disable said switching means, said AC power supply monitoring means comprising a first detector for detecting when noise with an excessively high voltage is superimposed on the AC power and in such cases producing a first detector signal, a second detector for detecting temporary drops in supply voltage and in such cases producing a second detector signal, and a disabling signal generator for producing said disabling signal in response to one of said first and second detector signals.

19. A high-frequency induction heating system comprising:

an AC power source means for supplying AC power;

a first DC power source for converting AC power from said AC power source into first DC power;

a second DC power source for converting AC power from said AC power source into second DC power;

an induction means, receiving said first DC power supply, for generating a magnetic flux therearound;

a switching means, associated with said induction means, for periodically transmitting and interrupting said first DC power to said induction means at a high frequency so that said magnetic flux oscillates;

a drive means, associated with said switching means and receiving said second DC power from said second DC power source, for supplying a driving signal to said switching circuit by which the latter is ordered to periodically transmit and interrupt said first DC power; and means for monitoring AC power supplied from said second AC power source and detecting preselected disabling conditions in said AC power supply and in such cases generating a disabling signal to disable said switching means, said AC power supply monitoring means comprising a first detector for detecting when noise with an excessively high voltage is superimposed on the AC power and in such cases producing a first detector signal, a second detector for detecting the onset of AC power supply and in such cases producing a second detector signal, and a disabling signal generator for producing said disabling signal in response to one of said first and second detector signals.

20. A high-frequency induction heating system as set forth in claim 13, wherein said AC power supply monitoring means comprises a first detector for detecting temporary drops in supply voltage and in such cases producing a first detector signal, a second detector for detecting the onset of AC power supply and in such cases producing a second detector signal, and a disabling signal generator for producing said disabling signal in response to one of said first and second detector signals.

21. A high-frequency induction heating system comprising:

an AC power source means for supplying AC power;

a first DC power source for converting AC power from said AC power source into first DC power;

a second DC power source for converting AC power from said AC power source into second DC power;

an induction means, receiving said first DC power supply, for generating a magnetic flux therearound;

a switching means, associated with said induction means, for periodically transmitting and interrupting said first DC power to said induction means at a high frequency so that said magnetic flux oscillates;

a drive means, associated with said switching means and receiving said second DC power from said second DC power source, for supplying a driving signal to said switching circuit by which the latter is ordered to periodically transmit and interrupt said first DC power; and means for monitoring AC power supplied from said second AC power source and detecting preselected disabling conditions in said AC power supply and in such cases generating a disabling signal to disable said switching means, said AC power supply monitoring means comprising a first detector for detecting when noise with an excessively high voltage is superimposed on the AC power and in such cases producing a first detector signal, a second detector for detecting temporary drops in supply voltage and in such cases producing a second detector signal, a third detector for detecting the onset of AC power supply and in such cases producing a third detector signal, and a disabling signal generator for producing said disabling signal in response to any of said first, second and third detector signals.

22. In a high-frequency induction heating system comprising a power source means for supply electrical power, an induction means for generating a magnetic flux therearound, and a switching means, associated with said induction means, for periodically interrupting the power supply to said induction means at a high frequency so that said magnetic flux oscillates, a method for protecting a circuit of said induction heating system comprising the steps of:

detecting onset of the power supply;

monitoring the power supply and detecting when the power supply conditions fall outside of predetermined acceptable conditions; and generating a disabling signal to disable said switching means in response to the oneset of the power supply for a given period of time and to an unacceptable condition outside of said predetermined acceptable conditions detected by said monitoring step.

23. A method as set forth in claim 22, wherein said step of monitoring the power supply, a supply voltage exceeding a given value is detected to produce said disabling signal.

24. In a high-frequency induction heating system comprising a power source means for supplying electrical power, an induction means for generating a magnetic flux therearound, and a switching means, associated with said induction means, for periodically interrupting the power supply to said induction means at a high frequency so that said magnetic flux oscillates, a method for protecting a circuit of said induction heating system comprising the steps of:

monitoring the power supply and detecting when the power supply conditions fall outside of predetermined acceptable conditions, which step is further performed by detecting noise of excessively high voltage superimposed on the power supply to produce said disabling signal; and generating a disabling signal to disable said switching means in response to said detecting step.

25. A method as set forth in claim 22, wherein said step of monitoring the power supply is further defined by the step of detecting temporary drops in supply voltage to produce said disabling signal.

26. A method as set forth in claim 22, wherein said step of monitoring the power supply is further defined by the step of detecting the onset of the power supply to produce said disabling signal for a given period of time.

27. In a high-frequency induction heating system comprising a power source means for supplying electrical power, an induction means for generating a magnetic flux therearound, and a switching means, associated with said induction means, for periodically interrupting the power supply to said induction means at a high frequency so that said magnetic flux oscillates, a method for protecting a circuit of said induction heating system comprising the steps of:

monitoring the power supply and detecting when the power supply conditions fall outside of predetermined acceptable conditions, which step is further performed by detecting when noise with an excessively high voltage is superimposed on the AC power and in such cases producing a first signal, a second step of detecting temporary drops in supply voltage to produce a second signal, and a third step of generating said disabling signal in response to one of said first and second signals; and generating a disabling signal to disable said switching means in response to either of said detecting steps.

28. In a high-frequency induction heating system comprising a power source means for supplying electrical power, an induction means for generating a magnetic flux therearound, and a switching means, associated with said induction means, for periodically interrupting power supply to said induction means at a high frequency so that said magnetic flux oscillates, a method for protecting a circuit of said induction heating system comprising the steps of:

monitoring the power supply and detecting when the power supply conditions falls outside of predetermined acceptable conditions, in which step is further performed by detecting when noise with an excessively high voltage is superimposed on the AC power and in such cases producing a first signal, a second step of detecting the onset of the power supply to produce a second signal, and a third step of generating said disabling signal in response to one of said first and second signals: and generating a disabling signal to disable said switching means in response to any of said detecting steps.

29. A method as set forth in claim 22, wherein said step of monitoring the power supply includes a first step of detecting temporary drops in supply voltage to produce a first signal, a second step of detecting the onset of the power supply to produce a second signal, and a third step of generating said disabling signal in response to one of said first and second signals.

30. In a high-frequency induction heating system comprising a power source means for supplying electrical power, an induction means for generating a magnetic flux therearound, and a switching means, associated with said induction means, for periodically interrupting the power supply to said induction means at a high frequency so that said magnetic flux oscillates, a method for protecting a circuit of said induction heating system comprising the steps of:

monitoring the power supply and detecting when the power supply conditions fall outside of predetermined acceptable conditions, which step is further performed by detecting when noise with an excessively high voltage is superimposed on the AC power and in such cases producing a first signal, a second step of detecting temporary drops in supply voltage to produce a second signal, a third step of detecting the onset of power supply to produce a third signal, and a fourth step of generating said disabling signal in response to one of said first, second and third signals; and generating a disabling signal to disable said switching means in response to any of said detecting steps.

31. A high-frequency induction heating system comprising:

an AC power source means for supply AC power;

an DC power source for converting AC power from said AC power source into DC power;

an induction means, receiving said first DC power supply, for generating a magnetic flux therearound;

a switching means, associated with said induction means, for periodically transmitting and interrupting said DC power to said induction means at a high frequency so that said magnetic flux oscillates;

a drive means, associated with said switching means and receiving said DC power from said DC power source, for supplying a driving signal to said switching circuit by which the latter is ordered to periodically transmit and interrupt said DC power; and means for detecting preselected disabling conditions in said AC power supply and in such cases generating a disabling signal to disable said switching means, said detecting means detecting noise of excessively high voltage superimposed on the supplied AC power for disabling said switching means.

* * * * *